US008196669B2

(12) United States Patent
Kriesels

(10) Patent No.: US 8,196,669 B2
(45) Date of Patent: Jun. 12, 2012

(54) METHOD OF DRILLING A WELLBORE

(75) Inventor: Petrus Cornelis Kriesels, Rijswijk (NL)

(73) Assignee: Shell Oil Company, Houston, TX (US)

( * ) Notice: Subject to any disclaimer, the term of this patent is extended or adjusted under 35 U.S.C. 154(b) by 144 days.

(21) Appl. No.: 12/743,644

(22) PCT Filed: Nov. 19, 2008

(86) PCT No.: PCT/EP2008/065800
§ 371 (c)(1),
(2), (4) Date: May 19, 2010

(87) PCT Pub. No.: WO2009/065844
PCT Pub. Date: May 28, 2009

(65) Prior Publication Data

US 2010/0276202 A1 Nov. 4, 2010

(30) Foreign Application Priority Data

Nov. 21, 2007 (EP) ..... 07121180

(51) Int. Cl.
*E21B 17/00* (2006.01)
*E21B 17/20* (2006.01)

(52) U.S. Cl. ..... 166/380; 166/384; 166/242.2

(58) Field of Classification Search ..... 166/380, 166/384, 55, 242.2; 138/98, 97; 175/226
See application file for complete search history.

(56) References Cited

U.S. PATENT DOCUMENTS

| | | | | |
|---|---|---|---|---|
| 2,927,775 | A | 3/1960 | Hildebrandt | 255/72 |
| 3,674,100 | A | 7/1972 | Becker | 175/69 |
| 4,522,125 | A * | 6/1985 | Marz | 102/313 |
| 5,454,401 | A * | 10/1995 | Kamiyama et al. | 138/98 |
| 5,680,885 | A * | 10/1997 | Catallo | 138/98 |
| 5,803,666 | A | 9/1998 | Keller | 405/146 |
| 5,853,049 | A * | 12/1998 | Keller | 166/380 |
| 7,096,890 | B2 * | 8/2006 | Woolstencroft et al. | 138/98 |
| 7,387,174 | B2 * | 6/2008 | Lurie | 175/57 |
| 2009/0211765 | A1 * | 8/2009 | Keller | 166/377 |

FOREIGN PATENT DOCUMENTS

| | | |
|---|---|---|
| EP | 0044706 | 1/1982 |
| WO | WO03036025 | 5/2003 |
| WO | WO 2005024178 | 3/2005 |

* cited by examiner

*Primary Examiner* — Daniel P Stephenson

(57) ABSTRACT

A method of drilling a wellbore (1) into an earth formation is disclosed. The method comprises arranging a drill string (6) and an expandable tubular element (8) coaxially in the wellbore, the drill string having an axially extending fluid passage (30), the tubular element surrounding the drill string and having a lower end bent (12) radially outward and in axially reverse direction so as to form an expanded tubular section (10) extending around a remaining tubular section of the tubular element, said lower end defining a bending zone of the tubular element, wherein an annular space is formed between the drill string and the remaining tubular section.

18 Claims, 1 Drawing Sheet

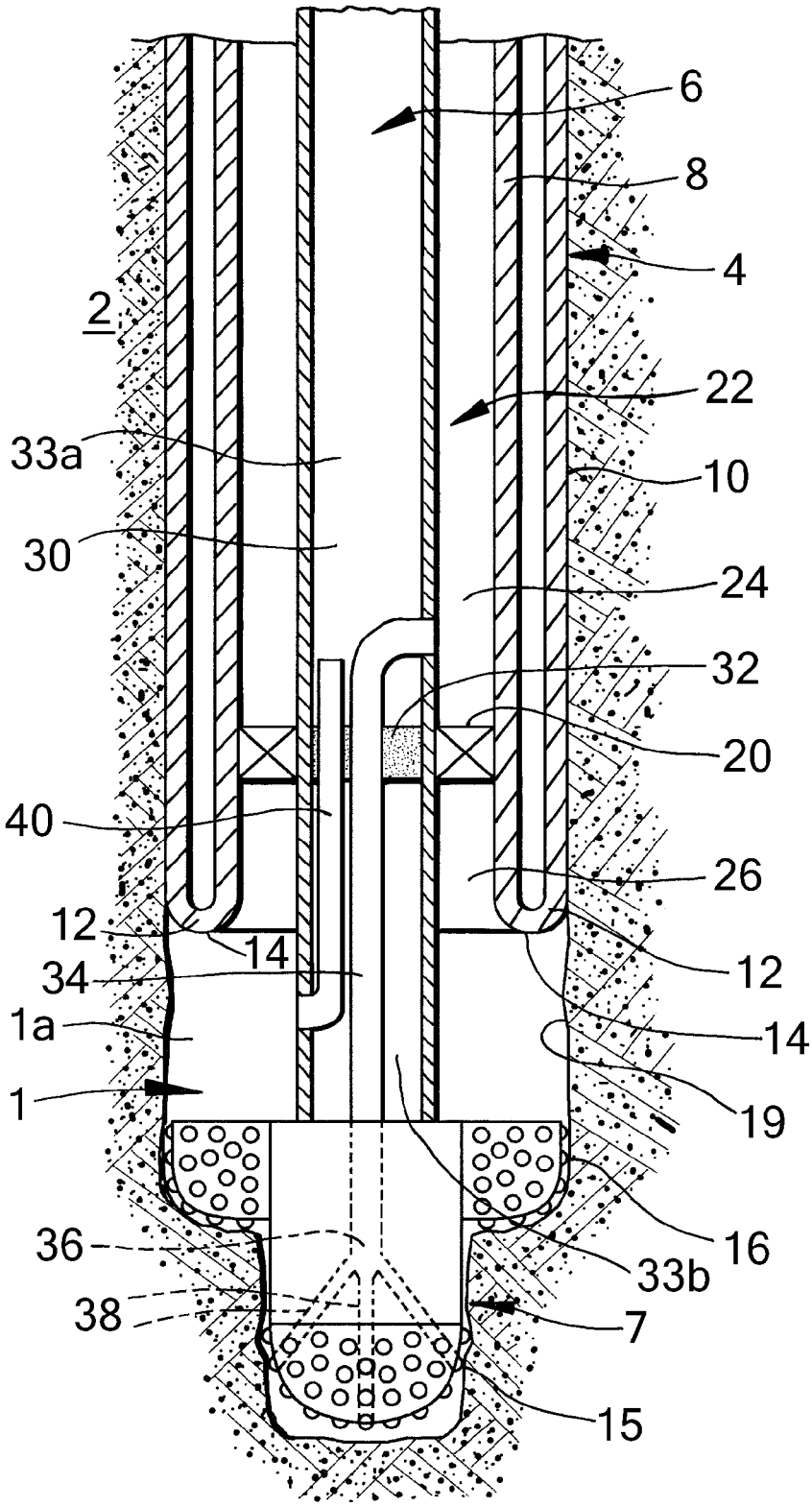
6
8
4
2
22
33a
10
30
24
32
20
40
26
12
14
12
34
1a
14
1
19
16
36
33b
38
7
15

METHOD OF DRILLING A WELLBORE

PRIORITY CLAIM

The present application claims priority of PCT Application EP2008/065800, filed 19 Nov. 2008, which claims priority to European Patent Application No. EP 07121180.9, filed 21 Nov. 2007.

TECHNICAL FIELD OF THE INVENTION

The present invention relates to a method of drilling a wellbore into an earth formation.

BACKGROUND OF THE INVENTION

In the technology of wellbore construction, it has become general practice to expand one or more tubular elements in the wellbore, for example to form a wellbore casing or liner that provides stability to the wellbore wall, and/or zonal isolation between different earth formation layers. Generally the term "casing" is used if the tubular element extends from surface into the wellbore, and the term "liner" is used if the tubular element extends from a downhole location further into the wellbore. However, in the present context, the terms "casing" and "liner" are used interchangeably and without such intended distinction.

In conventional wellbore construction, several casings are set at different depth intervals, and in a nested arrangement, whereby each subsequent casing is lowered through the previous casing and therefore has a smaller diameter than the previous casing. As a result, the cross-sectional wellbore size that is available for oil and gas production, decreases with depth. To alleviate this drawback, one or more tubular elements are radially expanded at the desired depth in the wellbore, to form an expanded casing, expanded liner, or a clad against an existing casing or liner. Also, it has been proposed to radially expand each subsequent casing to substantially the same diameter as the previous casing to form a monobore wellbore. It is thus achieved that the available diameter of the wellbore remains substantially constant along (a portion of) its depth as opposed to the conventional nested arrangement.

EP 1438483 B1 discloses a method of radially expanding a tubular element in a wellbore whereby the tubular element, in unexpanded state, is initially attached to a drill string during drilling of a new wellbore section. Thereafter the tubular element is radially expanded and released from the drill string.

To expand such wellbore tubular element, generally a conical expander is used with a largest outer diameter substantially equal to the required tubular diameter after expansion. The expander is pumped, pushed or pulled through the tubular element. Such method can lead to high friction forces that need to be overcome, between the expander and the inner surface of the tubular element. Also, there is a risk that the expander becomes stuck in the tubular element.

EP 0044706 A2 discloses a method of radially expanding a flexible tube of woven material or cloth by eversion thereof in a wellbore, to separate drilling fluid pumped into the wellbore from slurry cuttings flowing towards the surface.

SUMMARY OF THE INVENTION

It is an object of the invention to provide an improved method of drilling a wellbore.

In accordance with the invention there is provided a method of drilling a wellbore into an earth formation, the method comprising a) arranging a drill string and an expandable tubular element coaxially in the wellbore, the drill string having an axially extending fluid passage, the tubular element surrounding the drill string and having a lower end bent radially outward and in axially reverse direction so as to form an expanded tubular section extending around a remaining tubular section of the tubular element, said lower end defining a bending zone of the tubular element, wherein an annular space is formed between the drill string and the remaining tubular section;

b) inducing the drill string to further drill the wellbore;

c) inducing the bending zone to move in axial direction relative to the remaining tubular section so as to increase the length of the expanded tubular section;

d) inducing a stream of drilling fluid to flow into the wellbore via the annular space, and discharging the stream of drilling fluid from the wellbore via the fluid passage of the drill string.

Thus, the tubular element is effectively turned inside out during the bending process. The bending zone of a respective layer defines the location where the bending process takes place. By inducing the bending zone to move in axial direction along the tubular element it is achieved that the tubular element is progressively expanded without the need for an expander that is pushed, pulled or pumped through the tubular element.

Furthermore, with the method of the invention it is achieved that the risk that the liner becomes exposed to very high gas pressures in the event of a gas-kick during drilling, is significantly reduced. In such event, the wellbore traverses a formation containing gas at high pressure whereby a volume of the high-pressure gas flows into the return stream of drilling fluid present in the wellbore. Since the return stream of drilling fluid, which contains high-pressure gas, is discharged from the wellbore via the fluid passage of the drill string rather than via the annular space, the liner is not exposed to the high-pressure gas. Consequently, there is a reduced risk of overstressing the liner, and less stringent design requirements may apply to the liner.

In order to channel the stream of drilling fluid through on or more nozzles at the lower end of the drill string, as in conventional wellbore drilling, suitably the remaining tubular section is sealed relative to the drill string.

For example, if the drill string is provided with a drill bit having a fluid channel arranged to inject drilling fluid into the wellbore, preferably the stream of drilling fluid is induced to flow from the annular space into the wellbore via the fluid channel.

It is preferred that the wall of the tubular element includes a material that is plastically deformed in the bending zone, so that the expanded tubular section retains an expanded shape as a result of said plastic deformation. In this manner it is achieved that the expanded tubular section remains in expanded form due to plastic deformation, i.e. permanent deformation, of the wall. Thus, there is no need for an external force or pressure to maintain the expanded form. If, for example, the expanded tubular section has been expanded against the wellbore wall as a result of said bending of the wall, no external radial force or pressure needs to be exerted to the expanded tubular section to keep it against the wellbore wall. Suitably the wall of the tubular element is made of a metal such as steel or any other ductile metal capable of being plastically deformed by eversion of the tubular element. The expanded tubular section then has adequate collapse resistance, for example in the order of 100-150 bars.

In order to keep the bending zone close to the lower end of the drill string, it is preferred that step (c) comprises inducing the bending zone to move in downward direction of the wellbore, wherein the speed of downward movement of the bending zone is substantially equal to the speed of downward movement of the drill string during further drilling of the wellbore.

Suitably the bending zone is induced to move in axial direction relative to the remaining tubular section by inducing the remaining tubular section to move in axial direction relative to the expanded tubular section. For example, the expanded tubular section is held stationary while the remaining tubular section is moved in axial direction through the expanded tubular section to induce said bending of the wall.

In order to induce said movement of the remaining tubular section, preferably the remaining tubular section is subjected to an axially compressive force acting to induce said movement. The axially compressive force preferably at least partly results from the weight of the remaining tubular section. If necessary the weight can be supplemented by an external, downward, force applied to the remaining tubular section to induce said movement. As the length, and hence the weight, of the remaining tubular section increases, an upward force may need to be applied to the remaining tubular section to prevent uncontrolled bending or buckling in the bending zone.

If the bending zone is located at a lower end of the tubular element, whereby the remaining tubular section is axially shortened at a lower end thereof due to said movement of the bending zone, it is preferred that the remaining tubular section is axially extended at an upper end thereof in correspondence with said axial shortening at the lower end thereof. The remaining tubular section gradually shortens at its lower end due to continued reverse bending of the wall. Therefore, by extending the remaining tubular section at its upper end to compensate for shortening at its lower end, the process of reverse bending the wall can be continued until a desired length of the expanded tubular section is reached. The remaining tubular section can be extended at its upper end, for example, by connecting a tubular portion to the upper end in any suitable manner such as by welding. Alternatively, the remaining tubular section can be provided as a coiled tubing which is unreeled from a reel and subsequently inserted into the wellbore.

As a result of forming the expanded tubular section around the remaining tubular section, an annulus is formed between the unexpanded and expanded tubular sections. To increase the collapse resistance of the expanded tubular section, a pressurized fluid can be inserted into the annulus. The fluid pressure can result solely from the weight of the fluid column in the annulus, or in addition also from an external pressure applied to the fluid column.

The expansion process is suitably initiated by bending the wall of the tubular element at a lower end portion thereof by any suitable means.

Optionally the bending zone can be heated to promote bending of the tubular wall.

To reduce any buckling tendency of the unexpanded tubular section during the expansion process, the remaining tubular section advantageously is kept centralised within the expanded section.

BRIEF DESCRIPTION OF THE DRAWING

The invention will be described hereinafter in more detail and by way of example, with reference to the accompanying drawings in which:

FIG. 1 schematically shows, in longitudinal section, an embodiment of a drilling system for use with the method of the invention.

DETAILED DESCRIPTION OF THE PREFERRED EMBODIMENTS

Referring to FIG. 1 there is shown a wellbore 1 extending into an earth formation 2, a tubular element in the form of liner 4, and a drill string 6 having a drill bit 7 at its lower end. The drill string 6 and liner 4 extend coaxially in downward direction through the wellbore 1, whereby the liner 4 surrounds the drill string 6. A relatively short open-hole section 1*a* of the wellbore 1 extends below the liner 4.

The liner 4 has been partially radially expanded by eversion of the wall of the liner whereby a radially expanded tubular section 10 of the liner 4 has been formed having an outer diameter substantially equal to the wellbore diameter. A remaining tubular section 8 of the liner 4 extends concentrically within the expanded tubular section 10.

The wall of the liner 4 is, due to eversion at its lower end, bent radially outward and in axially reverse (i.e. upward) direction so as to form a U-shaped lower section 12 of the liner. The U-shaped lower section 12 interconnects the remaining liner section 8 and the expanded liner section 10, and defines a bending zone 14 of the liner 4.

The drill bit 7 comprises a pilot bit 15 with gauge diameter slightly smaller than the internal diameter of the remaining liner section 8, and a reamer section 16 with gauge diameter adapted to drill the wellbore 1 to its nominal diameter. The reamer section 16 is radially retractable to an outer diameter allowing it to pass through unexpanded liner section 8, so that the drill string 6 can be retrieved to surface through the unexpanded liner section 8.

The expanded liner section 10 is axially fixed to the wellbore wall 19 by virtue of frictional forces between the expanded liner section 10 and the wellbore wall 19 resulting from the expansion process. Alternatively, or additionally, the expanded liner section 10 can be anchored to the wellbore wall by any suitable anchoring means (not shown).

A seal element in the form of packer 20 is arranged in the annular space 22 between the drill string 6 and the remaining liner section 8 thereby defining an upper portion 24 of the annular space and a lower portion 26 of the annular space, said portions 24, 26 being sealed from each other by the packer 20. The packer 20 is fixedly connected to the drill string 6, and is adapted to rotate about its central longitudinal axis relative to the remaining liner section 8. Furthermore the packer 20 is adapted to slide in axial direction relative to the remaining liner section 8. Alternatively the packer 20 is non-rotating, whereby the drill string 6 can be rotating or non-rotating relative to the packer 20.

The drill string 6 has an axially extending fluid passage 30 provided with a seal member 32 arranged near a lower end of the drill string. The seal member 32 defines respective upper and lower portions 33*a*, 33*b* of the fluid passage 30, the portions 33*a*, 33*b* being sealed from each other by the seal member 32.

Furthermore, the drill string comprises a first conduit 34 that provides fluid communication between upper portion 24 of the annular space 22 and a fluid channel 36 of the drill bit 7, the fluid channel 36 being arranged to eject drilling fluid into the wellbore 1 via a plurality of drill bit nozzles 38. Also, the drill string comprises a second conduit 40 that provides fluid communication between the open-hole wellbore section 1*a* and the upper portion 33*a* of the fluid passage 30. The first and second conduits 34, 40 pass through the seal member 32.

During normal operation of the embodiment of FIG. 1, a lower end portion of the liner 4 is initially everted, that is, the lower end portion is bent radially outward and in axially reverse direction so as to initially form the U-shaped lower section 12 and a short length of expanded liner section 10. Subsequently, the short length of expanded liner section 10 is anchored to the wellbore wall by any suitable anchoring means. Depending on the geometry and/or material properties of the liner 4, alternatively the expanded liner section 10 can become anchored to the wellbore wall automatically due to friction between the expanded liner section 10 and the wellbore wall 19.

The unexpanded liner section 8 is then gradually moved downwardly while the expanded liner section 10 remains stationary, by application of a suitable downward force thereto at surface. The bending zone 14 of the liner 4 thereby gradually moves in downward direction, whereby the remaining liner section 8 is progressively everted so as to be transformed into the expanded liner section 10. During the eversion process, the bending zone 14 moves in downward direction at approximately half the speed of movement of the remaining liner section 8.

Simultaneously with downward movement of the remaining liner section 8, the drill string 6 is operated to further drill the wellbore 1 by rotation about its central longitudinal axis. The drill string 6 thereby moves deeper into the wellbore 1. The rate of downward movement of the remaining liner section 8 is controlled at surface so as to be substantially equal to the rate of downward movement of the drill string 6. In this manner it is achieved that the bending zone 14 remains close to the drill bit 7, and that consequently the length of the open-hole wellbore section 1*a* remains relatively short.

Since the length, and hence the weight, of the unexpanded liner section 8 gradually increases, the magnitude of downward force is gradually decreased. Eventually, the downward force may need to be replaced by an upward force to prevent buckling of the unexpanded liner section 8. Such upward force can be applied directly to the remaining liner section 8 at surface. Alternatively, the drill string 6 supports the remaining liner section 8 by suitable bearing means (not shown), so that the upward force can be applied to the drill string 6 at surface, and thence transmitted to the remaining liner section 8 via the bearing means. In such case, the weight of the unexpanded liner section 8, in combination with the downward force (if any), also can be used to provide a thrust force to the drill bit 7 during drilling.

Suitably the magnitude of the downward or upward force referred to hereinbefore, is controlled at surface so as to achieve simultaneous lowering of the drill string 6 and the remaining tubular section 8 at substantially the same speed.

During rotation of the drill string, a stream of drilling fluid is circulated through the wellbore 1 in reverse circulation mode. That is, the stream of fluid is pumped at surface into the annular space 22. From there, the stream flows downwardly through the upper portion 24 of annular space 22, and subsequently via the first conduit 34, the fluid channel 36 and nozzles 38, into the open-hole section 1*a* of wellbore 1. The stream of drilling fluid, with entrained rock cutting particles resulting from the drilling process, then flows via the second conduit 40 into the upper portion 33*a* of the drill string fluid passage 30, and thence upwardly to surface where the drilling fluid is processed in conventional manner.

In case of a gas-kick during drilling, whereby a volume of gas at high pressure flows from the formation into the open-hole section 1*a*, the volume of gas flows via the second conduit 40 and the fluid passage 30 to surface. Thus, the volume of gas does not flow to surface via the annular space 22 as in conventional drilling fluid circulation. Consequently, the liner 4 is not subjected to the high gas pressure during a gas-kick so that the risk of the burst pressure of the liner 4 being exceeded, is significantly reduced.

Also, it is an advantage of the method of the invention that the flow velocity of the stream of drilling fluid with entrained drill cuttings in the drill string fluid passage 30, is relatively high, so that adequate flow of the drill cuttings to surface is ensured. Similarly, in case the drilling fluid contains abrasive particles, for example as applied in abrasive jet drilling systems, the high flow velocity ensures improved flow of the abrasive particles with the drilling fluid stream to surface.

Another advantage of reverse fluid circulation as used with the method of the invention relates to the fluid pressure in the annular space 22, which is relatively high. This fluid pressure can be utilised to generate an additional thrust force to the drill string, for example if the packer 20 is axially fixed to the drill string 6. Also, the fluid pressure may be utilised to generate an additional downward force on the unexpanded liner section 8, for example if the packer 20 is temporarily axially fixed to the unexpanded liner section 8. Instead of rotating the drill string to deepen the wellbore, the drill bit can be driven by a downhole motor provided in the bottom hole assembly of the drill string, whereby the stream of drilling fluid drives the downhole motor.

As drilling proceeds, pipe sections are added at the top of unexpanded liner section 8 in correspondence with its lowering into the wellbore, as is normal practice for installing casings or liners into wellbores.

When it is required to retrieve the drill string 6 to surface, for example when the drill bit 7 needs to be replaced or when drilling of the wellbore 1 is complete, the reamer section 16 brought to its radially retracted mode. Subsequently the drill string 6 is retrieved to surface through the unexpanded liner section 8.

With the method of the invention, it is achieved that the wellbore is progressively lined with the everted liner during drilling directly above the drill bit. As a result, there is only a relatively short open-hole section of the wellbore during the drilling process at all times. The advantages of such short open-hole section will be most pronounced during drilling into a hydrocarbon fluid containing layer of the earth formation. In view thereof, for many applications it will be sufficient if the process of liner eversion during drilling is applied only during drilling into the hydrocarbon fluid reservoir, while other sections of the wellbore are lined or cased in conventional manner. Alternatively, the process of liner eversion during drilling may be commenced at surface or at a selected downhole location, depending on circumstances.

In view of the short open-hole section during drilling, there is a significantly reduced risk that the wellbore fluid pressure gradient exceeds the fracture gradient of the rock formation, or that the wellbore fluid pressure gradient drops below the pore pressure gradient of the rock formation. Therefore, considerably longer intervals can be drilled at a single nominal diameter than in a conventional drilling practice whereby casings of stepwise decreasing diameter must be set at selected intervals.

Also, if the wellbore is drilled through a shale layer, such short open-hole section eliminates possible problems due to heaving of the shale.

After the wellbore has been drilled to the desired depth and the drill string has been removed from the wellbore, the length of unexpanded liner section that is still present in the wellbore can be left in the wellbore or it can be cut-off from the expanded liner section and retrieved to surface.

In case the length of unexpanded liner section is left in the wellbore, there are several options for completing the wellbore. These are, for example, as follows.

A) A fluid, for example brine, is pumped into the annular space between the unexpanded and expanded liner sections 8, 10 so as to pressurise the annular space and increase the collapse resistance of the expanded liner section 10. Optionally one or more holes are provided in the U-shaped lower section 12 to allow the pumped fluid to be circulated.

B) A heavy fluid is pumped into the annular space so as to support the expanded liner section 10 and increase its collapse resistance.

C) cement is pumped into the annular space in order to create, after hardening of the cement, a solid body between the unexpanded liner section 8 and the expanded liner section 10, whereby the cement may expand upon hardening.

D) the unexpanded liner section 8 is radially expanded (i.e. clad) against the expanded liner section 10, for example by pumping, pushing or pulling an expander through the unexpanded liner section 8.

In the above examples, expansion of the liner is started at surface or at a downhole location. In case of an offshore wellbore whereby an offshore platform is positioned above the wellbore, at the water surface, it can be advantageous to start the expansion process at the offshore platform. In such process, the bending zone moves from the offshore platform to the seabed and from there further into the wellbore. Thus, the resulting expanded tubular element not only forms a liner in the wellbore, but also a riser extending from the offshore platform to the seabed. The need for a separate riser from is thereby obviated.

Furthermore, conduits such as electric wires or optical fibres for communication with downhole equipment can be extended in the annular space between the expanded and unexpanded sections. Such conduits can be attached to the outer surface of the tubular element before expansion thereof. Also, the expanded and unexpanded liner sections can be used as electricity conductors to transfer data and/or power downhole.

Since any length of unexpanded liner section that is still present in the wellbore after the eversion process, is subjected to less stringent loading conditions than the expanded liner section, such length of unexpanded liner section may have a smaller wall thickness, or may be of lower quality or steel grade, than the expanded liner section. For example, it may be made of pipe having a relatively low yield strength or relatively low collapse rating.

Instead of leaving a length of unexpanded liner section in the wellbore after the expansion process, the entire liner can be expanded with the method of the invention so that no unexpanded liner section remains in the wellbore. In such case, an elongate member, for example a pipe string, can be used to exert the necessary downward force to the unexpanded liner section during the last phase of the expansion process.

In order to reduce friction forces between the unexpanded and expanded tubular sections during the expansion process described in any of the aforementioned examples, suitably a friction reducing layer, such as a Teflon layer, is applied between the unexpanded and expanded tubular sections. For example, a friction reducing coating can be applied to the outer surface of the tubular element before expansion. Such layer of friction reducing material furthermore reduces the annular clearance between the unexpanded and expanded sections, thus resulting in a reduced buckling tendency of the unexpanded section. Instead of, or in addition to, such friction reducing layer, centralizing pads and/or rollers can be applied between the unexpanded and expanded sections to reduce the friction forces and the annular clearance there-between.

Instead of expanding the expanded liner section against the wellbore wall (as described above), the expanded liner section can be expanded against the inner surface of another tubular element already present in the wellbore.

The invention claimed is:

1. A method of drilling a wellbore into an earth formation, the method comprising a) arranging a drill string and an expandable tubular element coaxially in the wellbore, the drill string having an axially extending fluid passage, the tubular element surrounding the drill string and having a lower end bent radially outward and in axially reverse direction so as to form an expanded tubular section extending around a remaining tubular section of the tubular element, said lower end defining a bending zone of the tubular element, wherein an annular space is formed between the drill string and the remaining tubular section;

b) inducing the drill string to further drill the wellbore;

c) inducing the bending zone to move in axial direction relative to the remaining tubular section so as to increase the length of the expanded tubular section;

d) inducing a stream of drilling fluid to flow into the wellbore via the annular space, and discharging the stream of drilling fluid from the wellbore via the fluid passage of the drill string.

2. The method of claim 1, wherein a lower end portion of the remaining tubular section is sealed relative to the drill string.

3. The method of claim 1, wherein the drill string is provided with a drill bit having a fluid channel arranged to inject drilling fluid into the wellbore, and wherein the stream of drilling fluid is induced to flow from the annular space into the wellbore via the fluid channel.

4. The method of claim 1, wherein step (c) comprises inducing the bending zone to move in downward direction of the wellbore, and wherein the speed of downward movement of the bending zone is substantially equal to the speed of downward movement of the drill string during further drilling of the wellbore.

5. The method of claim 1, wherein the wall of the tubular element includes a material susceptible of plastic deformation in the bending zone during the bending process so that the expanded tubular section retains an expanded shape as a result of said plastic deformation.

6. The method of claim 1, wherein the bending zone is induced to move in axial direction relative to the remaining tubular section by inducing the remaining tubular section to move in downward direction relative to the expanded tubular section.

7. The method of claim 6, wherein the remaining tubular section is subjected to an axially compressive force acting to induce said movement of the remaining tubular section.

8. The method of claim 7, wherein said axially compressive force is at least partly due to an external force applied to the remaining tubular section.

9. The method of claim 1, wherein the remaining tubular section is axially shortened at a lower end thereof due to said movement of the bending zone, and wherein the method further comprises axially extending the remaining tubular section at an upper end thereof in correspondence with said axial shortening at the lower end thereof.

10. A drilling system for drilling a wellbore into an earth formation, the system comprising a) a drill string and an expandable tubular element extending coaxially in the wellbore, the drill string having an axially extending fluid passage, the tubular element surrounding the drill string and having a lower end bent radially outward and in axially reverse direction so as to form an expanded tubular section extending around a remaining tubular section of the tubular element, said lower end defining a bending zone of the tubular element, wherein an annular space is formed between the drill string and the remaining tubular section;

b) a drill bit for inducing the drill string to further drill the wellbore;

c) means for inducing the bending zone to move in axial direction relative to the remaining tubular section so as to increase the length of the expanded tubular section;

d) means for inducing a stream of drilling fluid to flow into the wellbore via the annular space, and discharging the stream of drilling fluid from the wellbore via the fluid passage of the drill string.

11. The system of claim 10, wherein a lower end portion of the remaining tubular section is sealed relative to the drill string.

12. The system of claim 10, wherein the drill string is provided with a drill bit having a fluid channel arranged to inject drilling fluid into the wellbore, and wherein the stream of drilling fluid is induced to flow from the annular space into the wellbore via the fluid channel.

13. The system of claim 10 wherein the speed of downward movement of the bending zone is substantially equal to the speed of downward movement of the drill string during further drilling of the wellbore.

14. The system of claim 10, wherein the wall of the tubular element includes a material susceptible of plastic deformation in the bending zone during the bending process so that the expanded tubular section retains an expanded shape as a result of said plastic deformation.

15. The system of claim 10, wherein the bending zone is induced to move in axial direction relative to the remaining tubular section by inducing the remaining tubular section to move in downward direction relative to the expanded tubular section.

16. The system of claim 15, wherein the remaining tubular section is subjected to an axially compressive force acting to induce said movement of the remaining tubular section.

17. The system of claim 16 wherein said axially compressive force is at least partly due to an external force applied to the remaining tubular section.

18. The system of claim 10, wherein the remaining tubular section is axially shortened at a lower end thereof due to said movement of the bending zone, and wherein the method further comprises axially extending the remaining tubular section at an upper end thereof in correspondence with said axial shortening at the lower end thereof.

* * * * *